US006020550A

United States Patent [19]

Yang

[11] Patent Number: 6,020,550

[45] Date of Patent: Feb. 1, 2000

[54] METHOD FOR BUILDING A TIMBRE SAMPLE DATABANK FOR A WAVEFORM TABLE

[75] Inventor: Ming-Che Yang, Kaohsiung, Taiwan

[73] Assignee: Winbond Electronics Corp., Hsinchu, Taiwan

[21] Appl. No.: 09/313,234

[22] Filed: May 17, 1999

[30] Foreign Application Priority Data

Dec. 30, 1998 [TW] Taiwan ..... 87121863

[51] Int. Cl.[7] ..... G10H 7/00

[52] U.S. Cl. ..... 84/603; 84/608; 84/622; 84/659

[58] Field of Search ..... 84/603–608, 622–625, 84/659–660

[56] References Cited

U.S. PATENT DOCUMENTS

| | | | |
|---|---|---|---|
| 5,288,940 | 2/1994 | Izumisawa | 84/603 |
| 5,672,836 | 9/1997 | Yoshida | 84/607 |
| 5,808,220 | 9/1998 | Yang | 84/601 |
| 5,808,222 | 9/1998 | Yang | 84/603 |

*Primary Examiner*—Brian Sircus
*Assistant Examiner*—Marlon Fletcher
*Attorney, Agent, or Firm*—J. C. Patents; Jiawei Huang

[57] ABSTRACT

An improved method for forming a timbre sample (Q sample) is described. A first Q sample is extracted. A fixed length of the first Q sample is extracted to form a first QL. A portion of the first Q sample other than the first QL is treated as a first pre-waveform. A last portion of the first pre-waveform is extracted and is processed with the second Q sample by a first COS modulation so as to obtain a second QL, which is connected to the first pre-waveform to form a second Q sample. A first period waveform of the second QL and a last portion of the first pre-waveform are processed by a second COS modulation to form a single period QL. Repeating the single period QL forms a third QL. Connecting the third QL to the first pre-waveform forms a third Q sample. The second QL is transformed by a digital Fourier transformation, and its high frequency modes are removed. The transformed second QL is inversely transformed back by an inverse digital Fourier transformation to form a fourth QL. Adding the third QL and the fourth QL forms a fifth WL sample, which power is properly normalized. A second pre-waveform is obtained by repeating the sixth QL. The first and second of pre-waveforms are processed by a linear cross fading algorithm to form a third pre-waveform. The third pre-waveform and the sixth QL are connected together to obtain an improved Q sample.

15 Claims, 16 Drawing Sheets

METHOD FOR BUILDING A TIMBRE SAMPLE DATABANK FOR A WAVEFORM TABLE

CROSS-REFERENCE TO RELATED APPLICATION

This application claims the priority benefit of Taiwan application serial no. 87121863, filed Dec. 30, 1998, the full disclosure of which is incorporated herein by reference.

BACKGROUND OF THE INVENTION

1. Field of the Invention

This invention relates to a waveform table for a music synthesizer, and more particularly to method for building a timbre sample databank for a waveform table so as to store various timbre waveforms for a music synthesizer.

2. Description of Related Art

A music synthesizer using a timbre waveform table to synthesize desired sounds is one of a class of music synthesizers having better capability of tone facsimile. Its synthesizing technology includes extracting a certain length, such as 0.1 second, of an actual sound waveform (W) of a pitch from a music instrument and digitizing it into a set of digital data. The set of digital data with its characterized timbre is stored in a memory to serve as a timbre sample, called a Q sample. When the music synthesizer is desired to play a sound, it plays the Q sample once and repeatedly plays the waveform of the last sound period or the last few sound periods of the Q sample. This repeated waveform unit length of the Q sample is called a QL. This synthesizing technology of a music synthesizer is schematically shown in FIG. 1. In FIG. 1, an actual sound waveform W with a certain pitch is extracted from a music instrument. A Q sample is obtained and stored in the memory of the music synthesizer. A synthesized sound waveform R with a repeated waveform unit length QL is played. In this manner, the QL quality determines the tone quality. According to music theory and experiment results, a good QL should satisfy several conditions as follows:

C1. The QL length must be an integer factor of a basic period of the Q sample. Since the Q sample is played only once, a complete synthesized sound is maintained by repeating the QL. If the QL length is not an integer factor of the basic period of the Q sample, each repeat of QL has a discontinuity at the beginning of each QL. For example, a Q sample for a pitch A4 with a frequency of 440 Hz is to be synthesized and played. This A4 Q sample has a basic period of $1/440$, which is about 0.002273 seconds. If the basic period is sampled by a sampling frequency of 44000 Hz, one basic period has 100 sample points. The QL length must be exactly one hundred points or an integer multiple of one hundred points.

C2. The repeated QL must have a waveform that can be repeated with a smooth waveform joint for each repeat without inducing a noise. A natural sound from an instrument has a smooth, continuous wave without noise. If the synthesized waveform is not smooth at the joint, it produces a noise which degrades the sound quality.

C3. The repeated QL must have a waveform that simulates the actual sound waveform so as to obtain a facsimile tone.

C4. In order to simplify the hardware of the music synthesizer and efficiently use the memory to store various Q samples from various pitches of various instruments, each QL length of the Q samples and each Q sample length should have their single fixed quantities.

A synthesized sound should satisfy the above four requirements so as to produce a facsimile tone with good quality. However, it is difficult to simultaneously satisfy all the above four requirements. The difficulty can be see in a conventional process to form a timbre sample in the following descriptions, which includes several steps.

1. A length least common multiple (LCM) of the QL lengths of all various Q samples is obtained so as to satisfy condition C4.

2. In order to satisfy condition C4, a Q sample is obtained by extracting a fixed length, such as 0.1 second, from the beginning of an actual sound waveform. This can be seen in FIG. 2.

3. In FIG. 3, a QL from the last period of the Q sample with a length equal to one basic period is chosen.

4. In FIG. 4, a synthesizer sound waveform R is obtained by playing the Q sample once and repeatedly playing the QL.

In this conventional process, a timbre sample file generally satisfying conditions C1 and C4 is obtained, but it does not satisfy conditions of C2 and C3, resulting in several problems as follow:

1. For a Q sample having a regular waveform for each period, the conventional process with the four steps described above can obtain a high-quality Q sample. However, the waveforms and the periods of natural sounds from the instruments have slowly varying amplitude for each single period. In FIG. 5, in the practical situation, each period of a Q sample has a little variation of waveform and period length. As a QL is taken from the last period of the Q sample and repeatedly played to form a synthesized sound waveform R, the joint for each QL is not smooth, as shown in the lowest plot. This does not satisfy condition C2, and causes noise in the synthesized sound waveform R.

2. According to experiments, a QL length including only one basic period can produce a stable synthesized sound waveform R, but it appears to be a monotone. This can be seen in FIG. 6, where a Q sample exhibits variation of waveform in the actual sound waveform, but the synthesized sound waveform R with a QL length of one period lacks variation. In order to satisfy condition C3, a longer QL is the better, so that a synthesized sound waveform R with a variation similar to that of the original waveform is obtained. However, in this manner, a large difference between the front part and the end part of the chosen QL length may occur, giving rise to a trembling sound that periodically manifests in the synthesized sound waveform R. This also degrades the quality of the synthesized sound waveform R. In other word, a proper QL length needs to simultaneously consider the problems of monotone and trembling effects.

SUMMARY OF THE INVENTION

It is at least an objective of the present invention to provide a method for synthesizing a sound waveform to solve the conventional problems of monotone and trembling effects. On one hand, the method does not increase the hardware complexity and consumption, and can effectively avoid the noise induced by each rough QL joint. On the other hand, a balance point is reached between the monotone effect and the trembling effect. All four conditions C1, C2, C3, and C4 are satisfied.

In accordance with the foregoing and other objectives of the present invention, a method for reforming a timbre sample for a music synthesizer is provided. The method includes providing a first timbre sample S having a first repeated waveform SL at its last portion, and a second repeated timbre sample TL that has equal length to the first repeated waveform SL. The first repeated waveform SL of the first timbre sample S is replaced with the second repeated waveform TL so as to form a second timbre sample T, in which a portion of the first timbre sample S other than the first repeated waveform SL forms a first pre-waveform TH. A transformation operation is perform by transforming the first repeated waveform SL into a frequency domain by a digital Fourier transformation, extracting low frequency modes, and transforming the low frequency modes of the first repeated waveform SL back into an original space domain so as to form a third repeated waveform NSL. The second repeated waveform TL and the third repeated waveform NSL are added up so as to obtain a fourth repeated waveform SUML. A power of the fourth repeated waveform SUML is normalized to a power of the second repeated waveform TL so as to obtain a fifth repeated waveform FL. The fifth repeated waveform FL is repeatedly connected until a length greater than the length of the first pre-waveform TH is obtained. A last portion of the repeated fifth repeated waveform FL with a length equal to a length of the first pre-waveform TH so as to obtain a second pre-waveform AH. A linear cross fading operation is performed on the first pre-waveform TH and the second pre-waveform FH so as to obtain a third pre-waveform FH. The fifth repeated waveform FL is connected to the third pre-waveform FH so as to obtain a synthesized timbre sample F, which can be used to synthesize the synthesized sound waveform by repeating the synthesized timbre sample F.

The method of the invention for synthesizing desires sound is done through a software method. All various timbre samples with improved quality can be pre-formed and stored in a waveform table of a synthesizer for various uses. It is not necessary to greatly modify the hardware of the synthesizer. The waveform table can even be built once for all. Moreover, through proper adjusting the junction through junction modulations and the linear cross fading operation, the four conditions C1, C2, C3, and C4 are satisfied. Therefore, a high quality synthesized sound with greatly reduced noise is obtained.

In order to obtain the first timbre sample S, the first repeated waveform SL, and the second repeated waveform TL of above, the method further includes providing several digital native sound waveform files. One of the digital native sound waveform files is selected and extracted with a sufficient fixed length of waveform from a beginning point so as to form a basic timbre sample E. A last portion of waveform of the basic timbre sample E with a repeated length is selected to form a basic repeated waveform EL, in which the repeated length is a unit length and is to be repeated while synthesizing the synthesized sound waveform. A portion of the basic timbre sample E other than the basic repeated waveform EL forms the first pre-waveform TH. A first junction modulation is operated on the basic repeated waveform EL with a first previous waveform EP, which is selected from a last portion of the first pre-waveform TH with a length equal to the repeated length, so as to form the first repeated waveform SL. The basic repeated waveform EL of the basic timbre sample E is replaced by the first repeated waveform SL so as to form the first timbre sample S. A second junction modulation is operated on a first basic single period SL1 of the second repeated waveform SL with a second previous waveform SP1 from the last portion of the first pre-waveform TH with a length equal to a length of the first basic single period SL1. A single period waveform SF1 therefore is formed and repeatedly connected so as to form the second repeated waveform TL, which has a length equal to the length of the first repeated waveform SL.

The basic timbre sample E includes a sufficient length, which is obtained by a least common multiple (LCM) method for all various instrument type of the timbre sample E or just take a single period of the basic timbre E. The basic repeated waveform EL of the basic timbre sample E can include, for example, several basic periods with an integer repeated time so as to obtain an equal length to the the basic timbre sample E.

Moreover, the first junction modulation includes an arithmetic operation:

$$SF1(k) = SL1(k)\cdot\frac{1+\cos\left(\frac{k\pi}{M}\right)}{2} + SP1(k)\cdot\frac{1-\cos\left(\frac{k\pi}{M}\right)}{2},$$

$$k = 1, 2, \ldots M,$$

in which there are M sample points in the single period waveform SF1, and each point is denoted by k.

Furthermore, the low frequency modes of the third repeated waveform NSL include a frequency range K that is less than 1.5 of a frequency base f. The linear cross fading operation also includes an operation following an equation:

$$FH(i) = TH(i)\cdot\frac{(D-i)}{D} + AH(i)\cdot\frac{i}{D},\ i = 0, 1, \ldots D-1,$$

where D is the total sample points of the first pre-waveform TH, and each point is represented as "i". Furthermore, about normalizing the power of the fourth repeated waveform SUML to the power of the second repeated waveform TL, it is performed by timing each sample point of the fourth repeated waveform SUML by a factor. The factor is a ratio of a summation of each sample point square of the second repeated waveform TL to a summation of each sample point square of the fourth repeated waveform SUML.

BRIEF DESCRIPTION OF DRAWINGS

The invention can be more fully understood by reading the following detailed description of the preferred embodiment, with reference made to the accompanying drawings as follows.

DETAILED DESCRIPTION OF PREFERRED EMBODIMENT

The invention introduces a method for reforming a timbre sample for a music synthesizer. A synthesized sound waveform satisfies all four conditions C1, C2, C3, and C4 for a good sound quality, in which a choice between the monotone and trembling phenomena is optimized, and a discontinuity of the waveform is effectively smoothed so as to reduce a sound noise.

Figure 8:
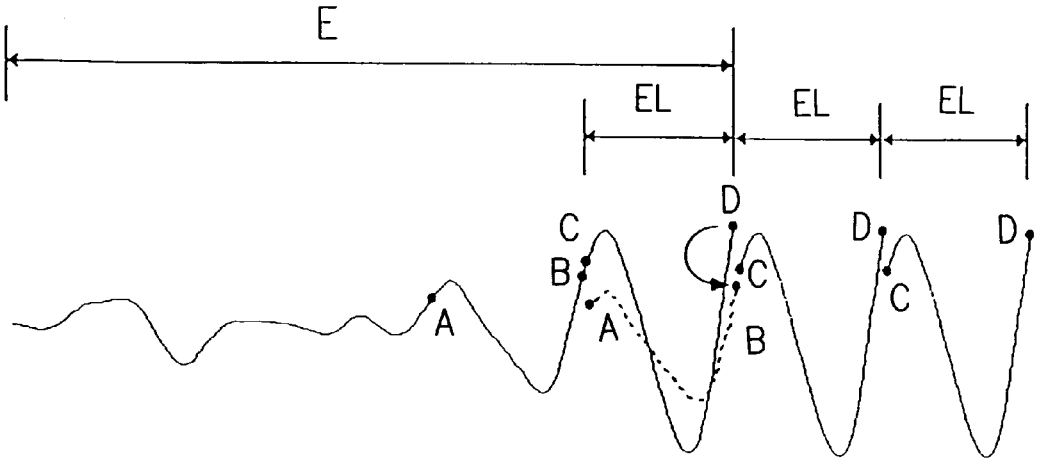
FIG. 8 is a schematic plot of a synthesized sound waveform with a timbre sample E and its repeated waveform EL, in which the synthesized sound waveform satisfies conditions C1 and C4, according to a preferred embodiment of the invention.
Figure 9:
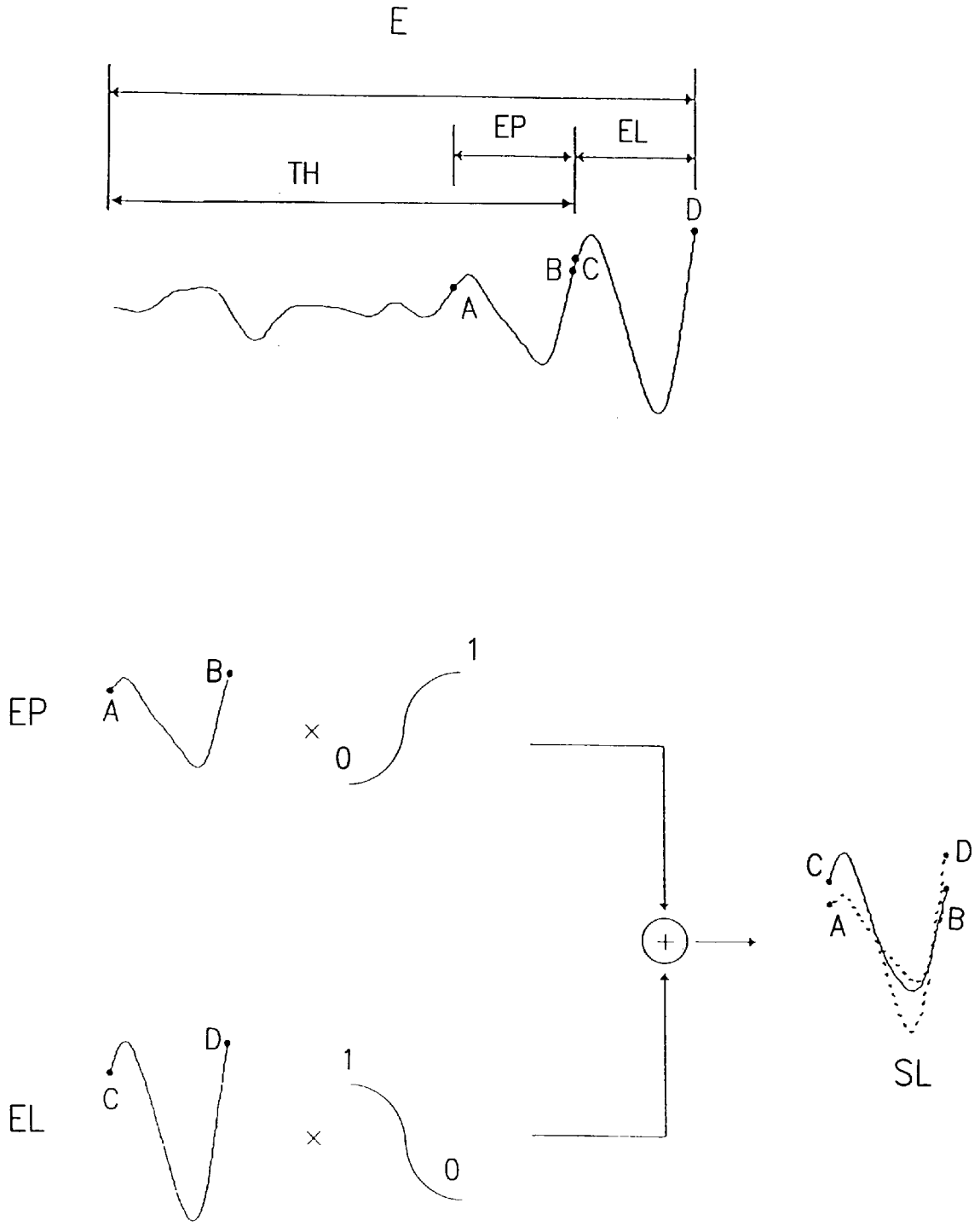
FIG. 9 is a schematic plot, illustrating a COS modulation method, according to the preferred embodiment of the invention.

First, the solution to reduce the noise is described in the following:

FIG. 8 is a schematic plot of a synthesized sound waveform with a timbre sample E and its repeated waveform EL, in which the synthesized sound waveform satisfies conditions C1 and C4, according to a preferred embodiment of the invention. In FIG. 8, a synthesized sound waveform satisfying conditions of C1 and C4 usually has a discontinuity occurring between a timbre sample E and a chosen repeated waveform unit length EL. The EL is repeatedly connected to the E sample, in a typical method of music synthesis as described in the beginning. The discontinuity occurs, for example, at the D-point and the C-point, and a noise results if the discontinuity is not resolved. For the C-point, the B-point is expected to have a smooth connection; so the solution should smoothly adjust the D-point to the B-point. The solution is shown in FIG. 9. FIG. 9 is a schematic plot, illustrating a COS modulation method, according to the preferred embodiment of the invention. In FIG. 9, the E sample is divided into the EL and a pre-wave form TH that is the portion other than the EL. The EL has, for example, N sample points, which are expressed by a digital series of EL(n), n=1,2, . . . ,N. A previous waveform EP measuring from the end point of the pre-waveform TH with an equal length to the EL is also extracted so that it is also expressed by a digital series of EP(n), n=1,2, . . . ,N. The EL and EP are processed by a cosine function modulation, called a COS modulation, so as to obtain a new repeated waveform form length SL, which is obtained by an equation:

$$SL(k) = EL(k)\cdot\frac{1+\cos\left(\frac{k\pi}{N}\right)}{2} + EP(k)\cdot\frac{1-\cos\left(\frac{k\pi}{N}\right)}{2}, \quad k = 1, 2, \ldots N. \tag{1}$$

Figure 1:
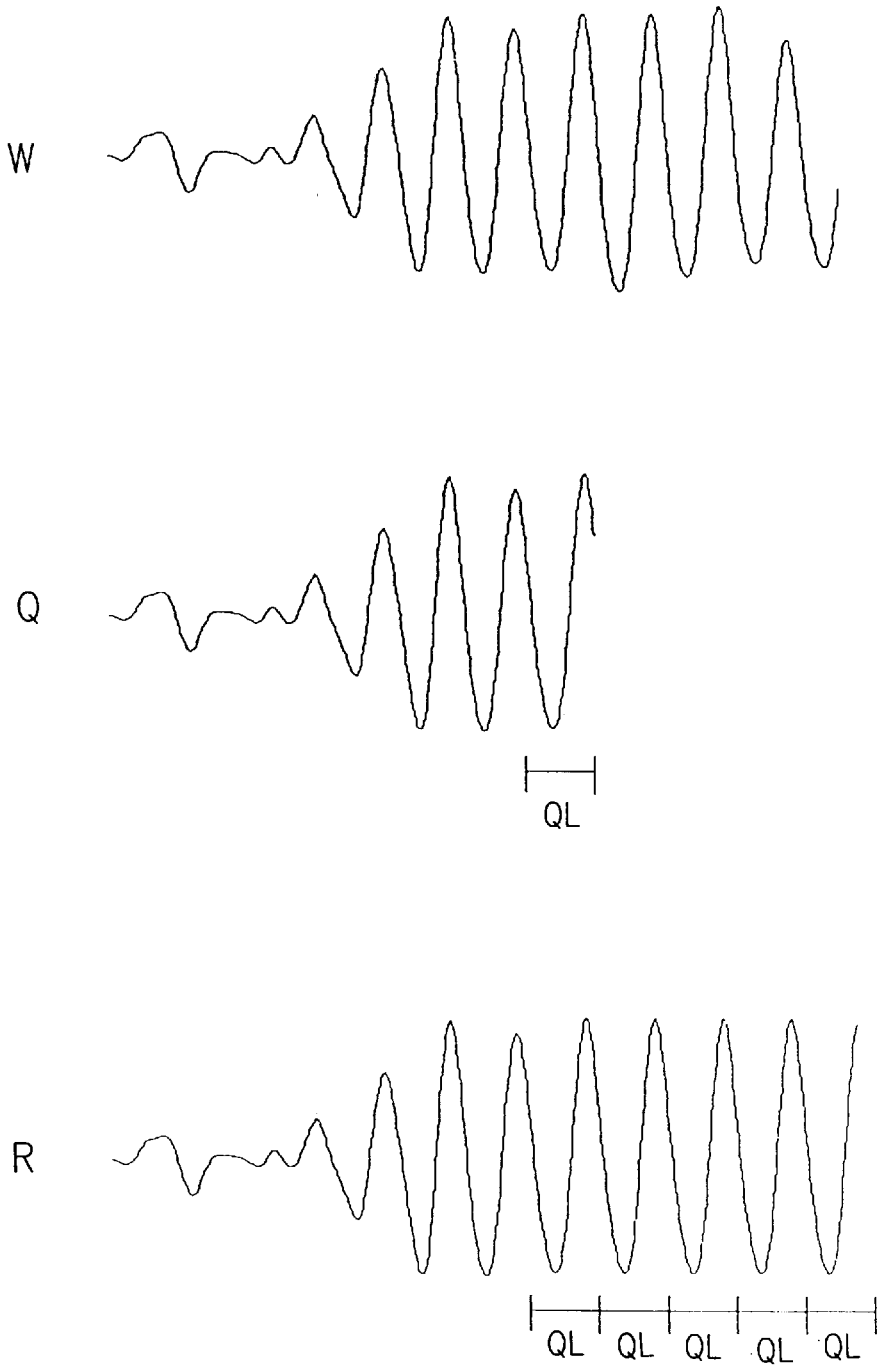
FIG. 1 (PRIOR ART)
FIG. 1 is a schematic plot of several waveforms, including an actual sound waveform W, a timber sample Q, and a synthesized sound waveform R.
Figure 2:
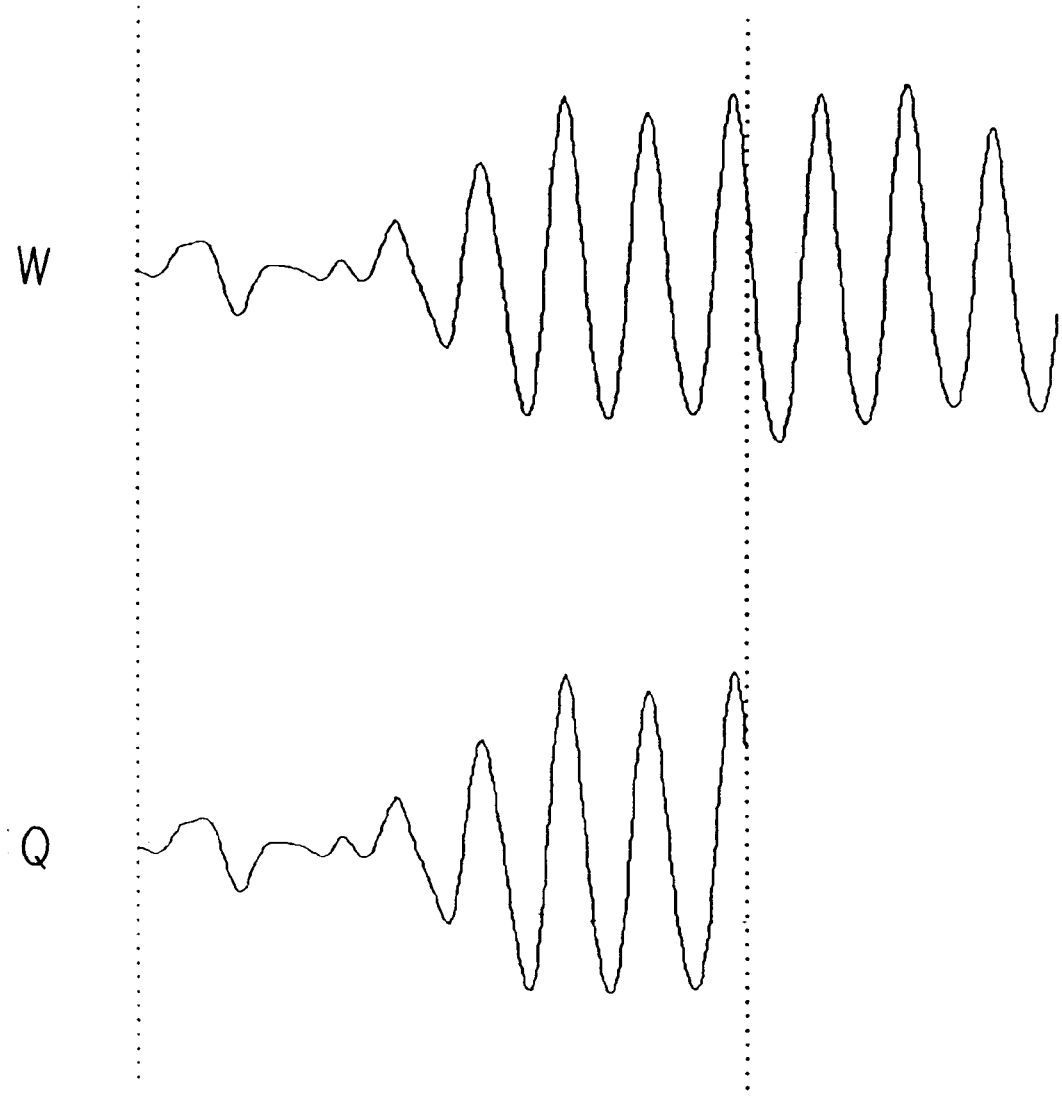
FIG. 2 (PRIOR ART)
FIG. 2 is a schematic plot of the actual sound waveform W and the Q sample, illustrating the length of the Q sample.
Figure 3:
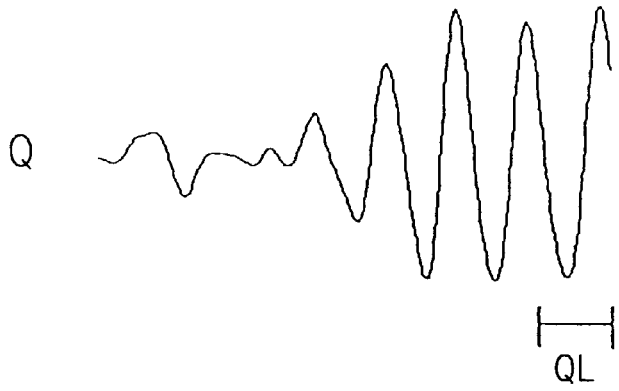
FIG. 3 (PRIOR ART)
FIG. 3 is a schematic plot of the Q sample, illustrating a length of a QL, which is a length to be repeatedly played.
Figure 4:
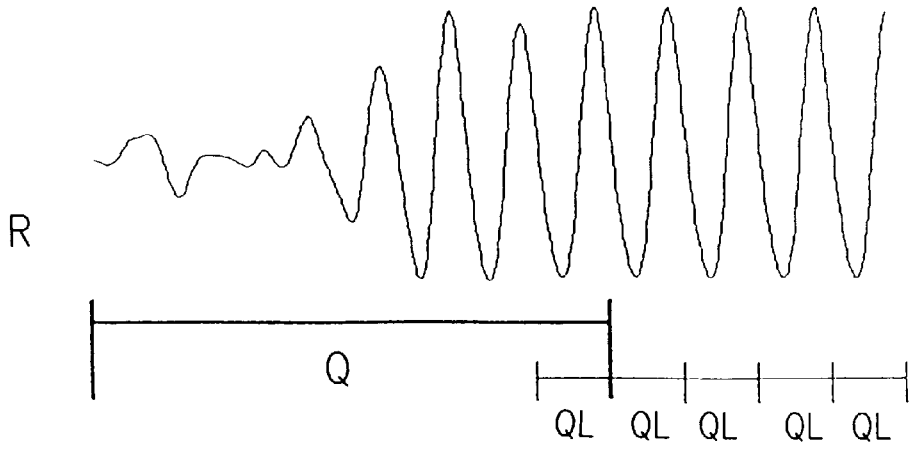
FIG. 4 (PRIOR ART)
FIG. 4 is a schematic plot of the synthesized sound waveform R, illustrating how it is synthesized.
Figure 5:
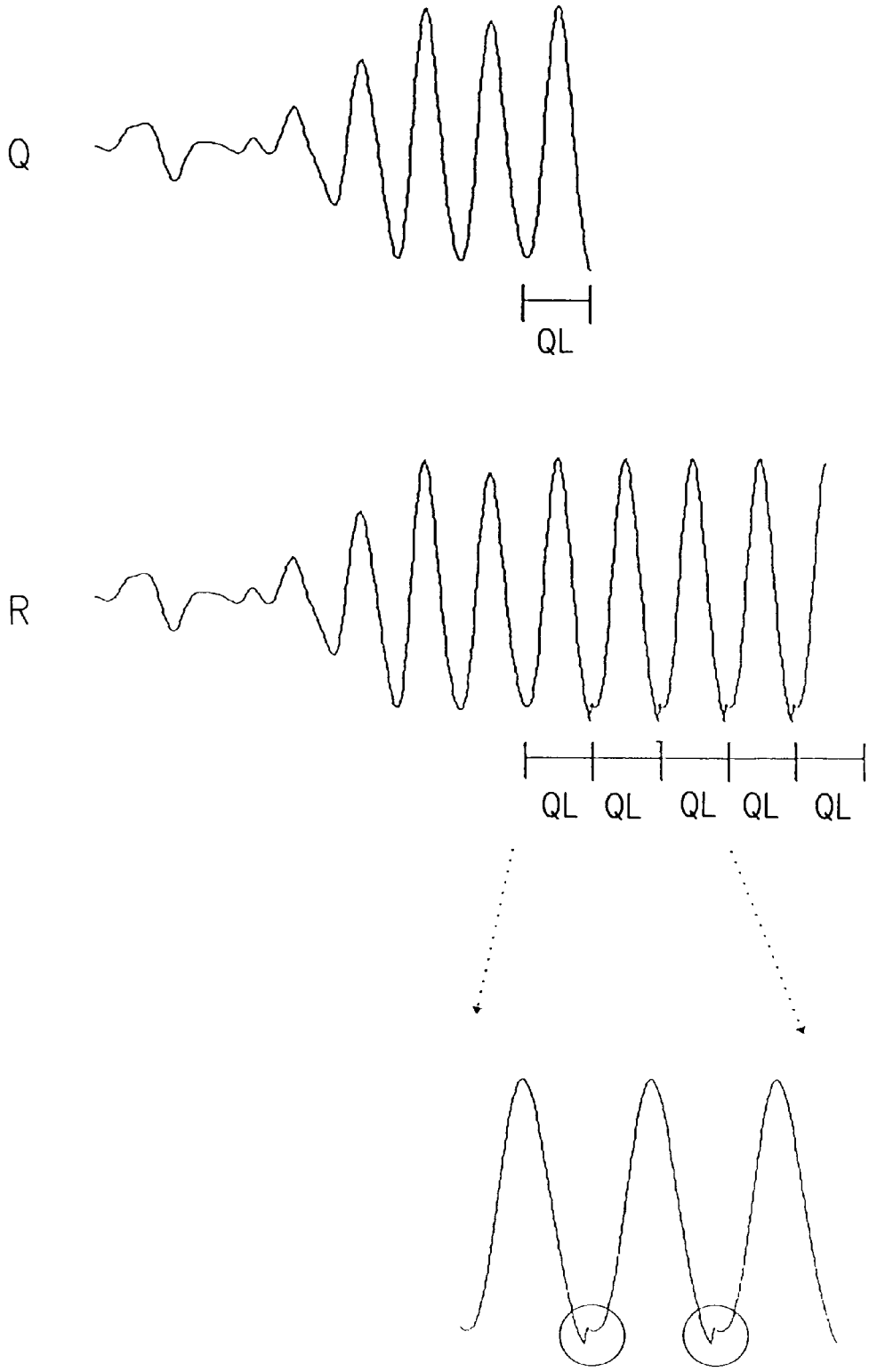
FIG. 5 (PRIOR ART)
FIG. 5 is a schematic plot of the Q sample and the synthesized sound waveform R, illustrating a noise structure.
Figure 6:
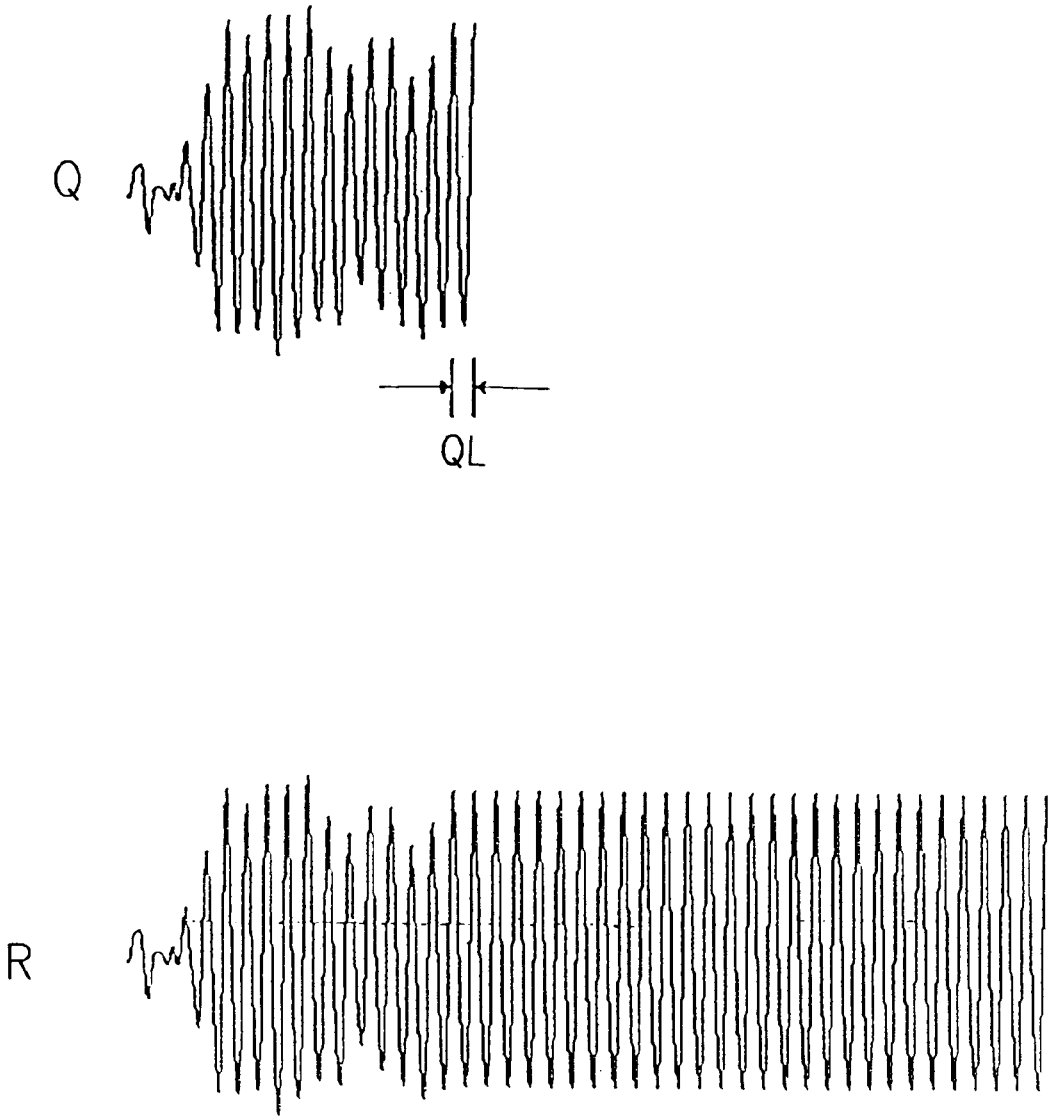
FIG. 6 (PRIOR ART)
FIG. 6 is a schematic plot of the Q sample and the synthesized sound waveform R, illustrating a monotone effect.
Figure 7:
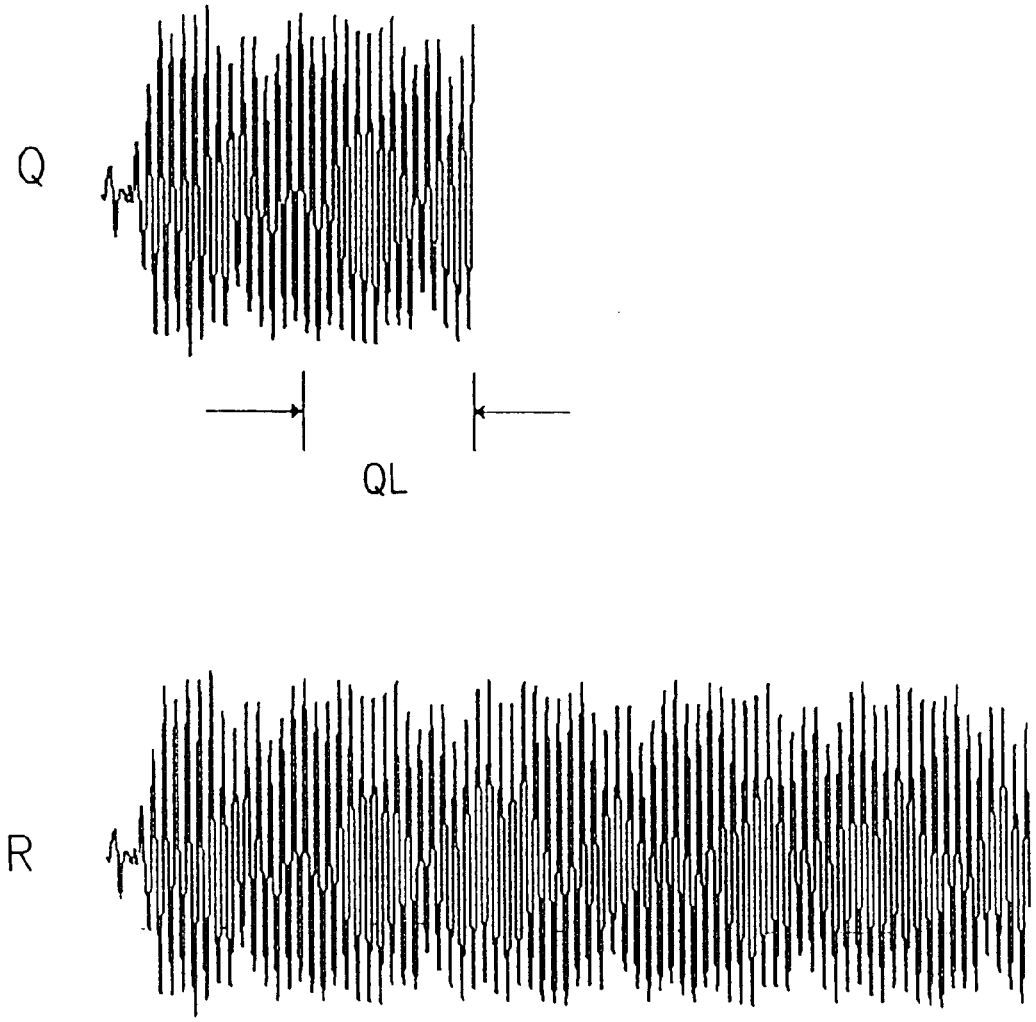
FIG. 7 (PRIOR ART)
FIG. 7 is a schematic plot of the Q sample and the synthesized sound waveform R, illustrating a trembling sounding effect.
Figure 10:
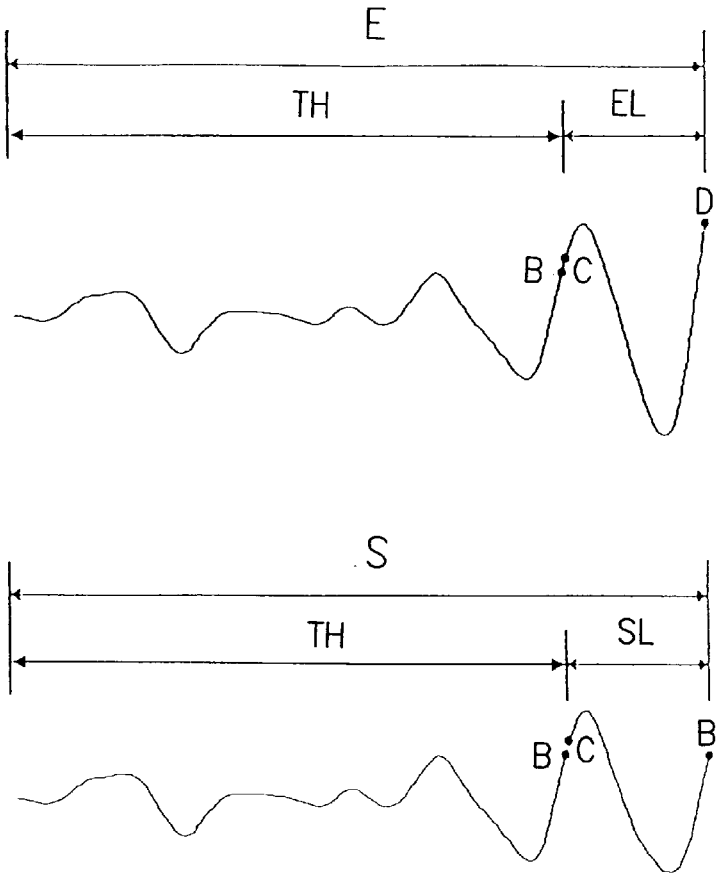
FIG. 10 is a schematic plot of the E sample and an S sample that is processed by the COS modulation according to the preferred embodiment of the invention.
Figure 11:
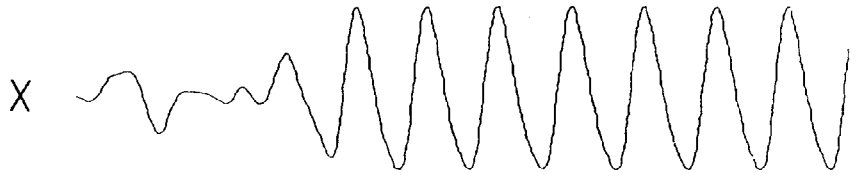
FIG. 11 is a schematic plot of a synthesized sound waveform X, which is synthesized through the S sample in FIG. 10 according to the preferred embodiment of the invention.

Eq. 1 describes the operation of the COS modulation, which is also schematically shown in FIG. 9 in the lower plot. Since SL(N)=EP(N) and SL(1)~EL(1), as the SL replaces the EL, the repeated connection has a smooth joint structure, as shown in FIG. 10. The purpose of the COS modulation is to obtain the SL, which has properties of smooth and similar waveform, SL(N)=EP(N), and SL(1)~EL(1) so that Eq. 1 is not the only mathematical formula that can achieve this purpose. Actually, a more complex form including more functions, for example, cosine, sine, or other periodic functions, can also be used to achieve this purpose. FIG. 10 is a schematic plot of the E sample and an S sample that are processed by the COS modulation, according to the preferred embodiment of the invention. In FIG. 10, the EL of the E sample is replaced by the SL so that a timbre sample S is obtained. The S sample includes the pre-waveform TH and the SL, which allows a smooth joint as the SL is repeatedly connected. A synthesized sound form X, shown in FIG. 11, is therefore obtained. The synthesized sound form X has no rough joints. A conventional noise, as shown in FIG. 5, is not induced.

Secondly, a solution to simultaneously solve the problems of the monotone and trembling sound phenomena is described in the following:

As mentioned before, amplitudes of a natural sound produced from a music instrument are always slowly varying and characterize the sound of the instrument. A monotone pitch is certainly not desirable. Conventionally, a similar variation of the sound waveform is obtained by increasing the length of the repeated waveform unit length QL, or the SL in the invention. However, a periodically trembling sound phenomenon is induced. Both the monotone and the trembling sound phenomena usually does coexist. In the invention, a compromise is obtained by an optimizing process to reform the synthesized sound waveform X.

Figure 12:
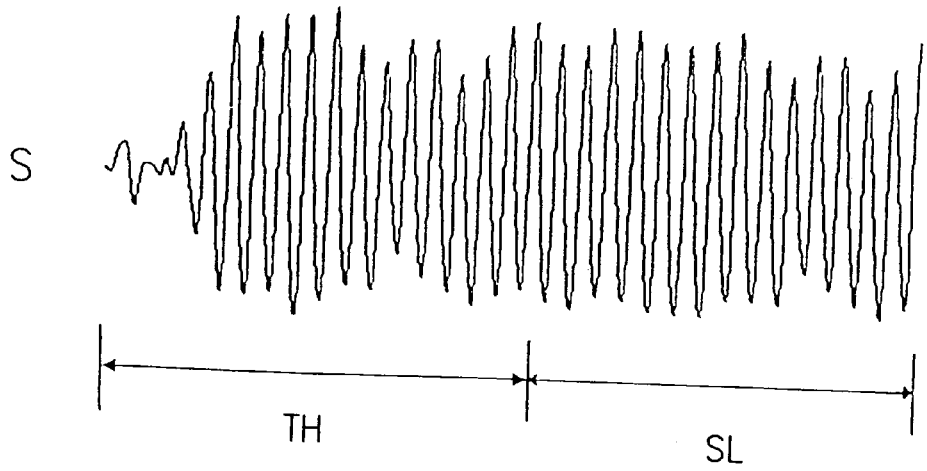
FIG. 12 is a schematic plot of an S sample, which has a sufficiently long SL that is processed by the COS modulation, according to the preferred embodiment of the invention.
Figure 13:
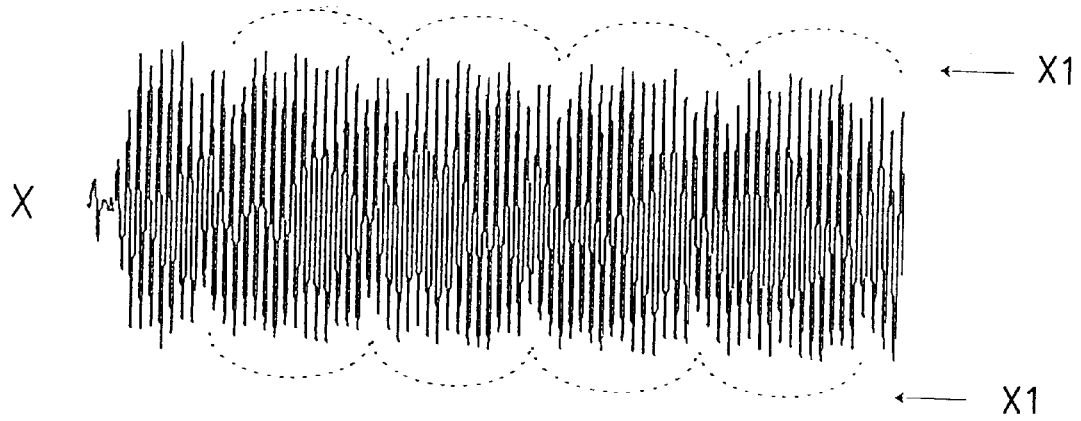
FIG. 13 is a schematic plot of a synthesized sound waveform X, which is synthesized through the S sample in FIG. 12, according to the preferred embodiment of the invention.

FIG. 12 is a schematic plot of an S sample, which has a sufficiently long SL that is processed by COS modulation, according to the preferred embodiment of the invention. In FIG. 12, an EL of FIG. 9, preferably including a sufficient length, is extracted and processed by COS modulation so as to obtain an SL with a sufficient length. The SL is connected to the pre-waveform TH so as to obtain an S sample that carries an amplitude variation to avoid a monotone phenomenon. The S sample is repeatedly connected by the SL to form a synthesized sound waveform X, as shown in FIG. 13. A trembling sound phenomenon is induced by a periodic wave Xl residing on a wave envelope of the synthesized sound waveform X, as shown in dotted line.

Figure 14:
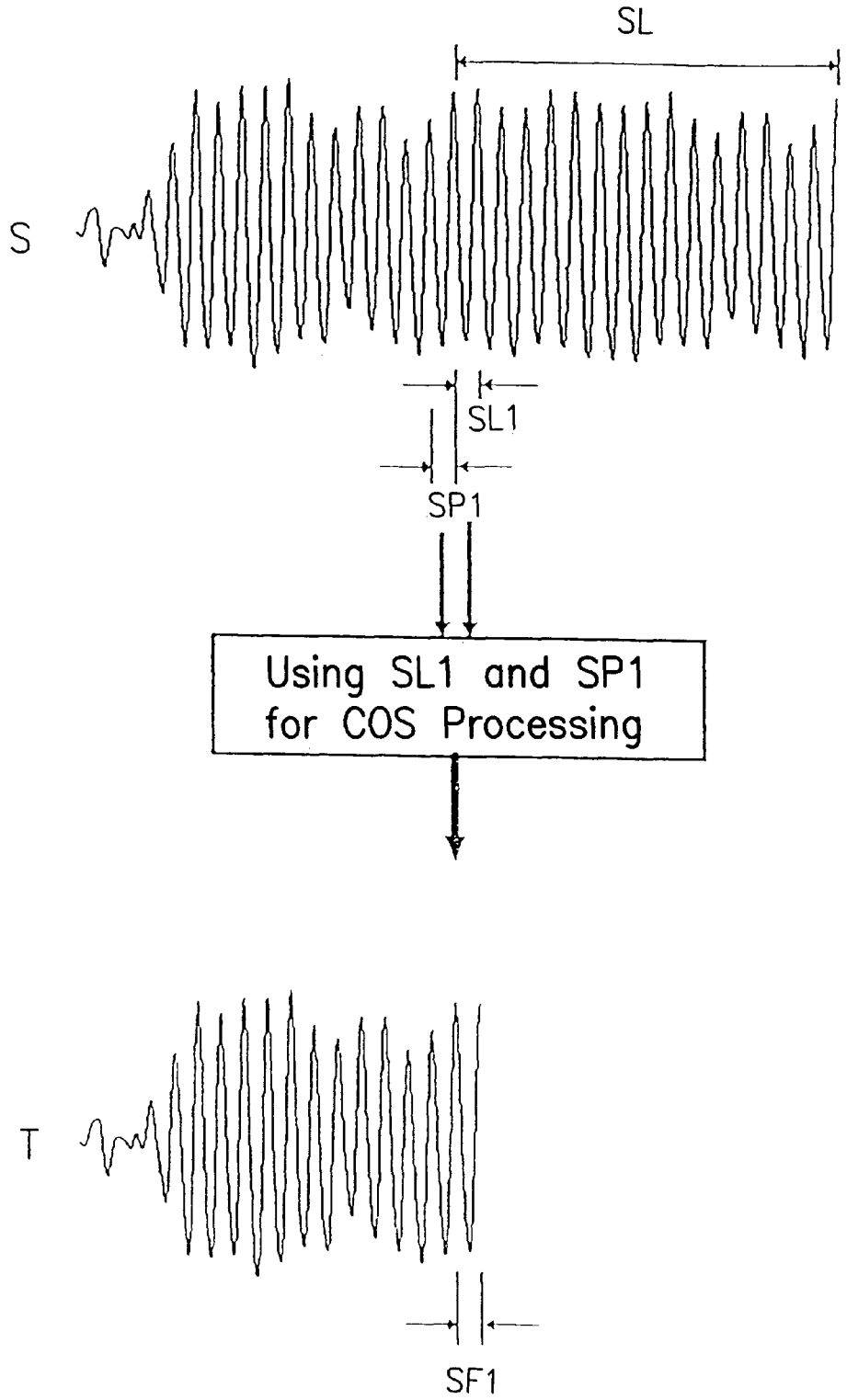
FIG. 14 is a schematic plot of the T sample that is a result of the S sample with the single period waveform SF1, which is processed by the COS modulation, according to the preferred embodiment of the invention.
Figure 15:
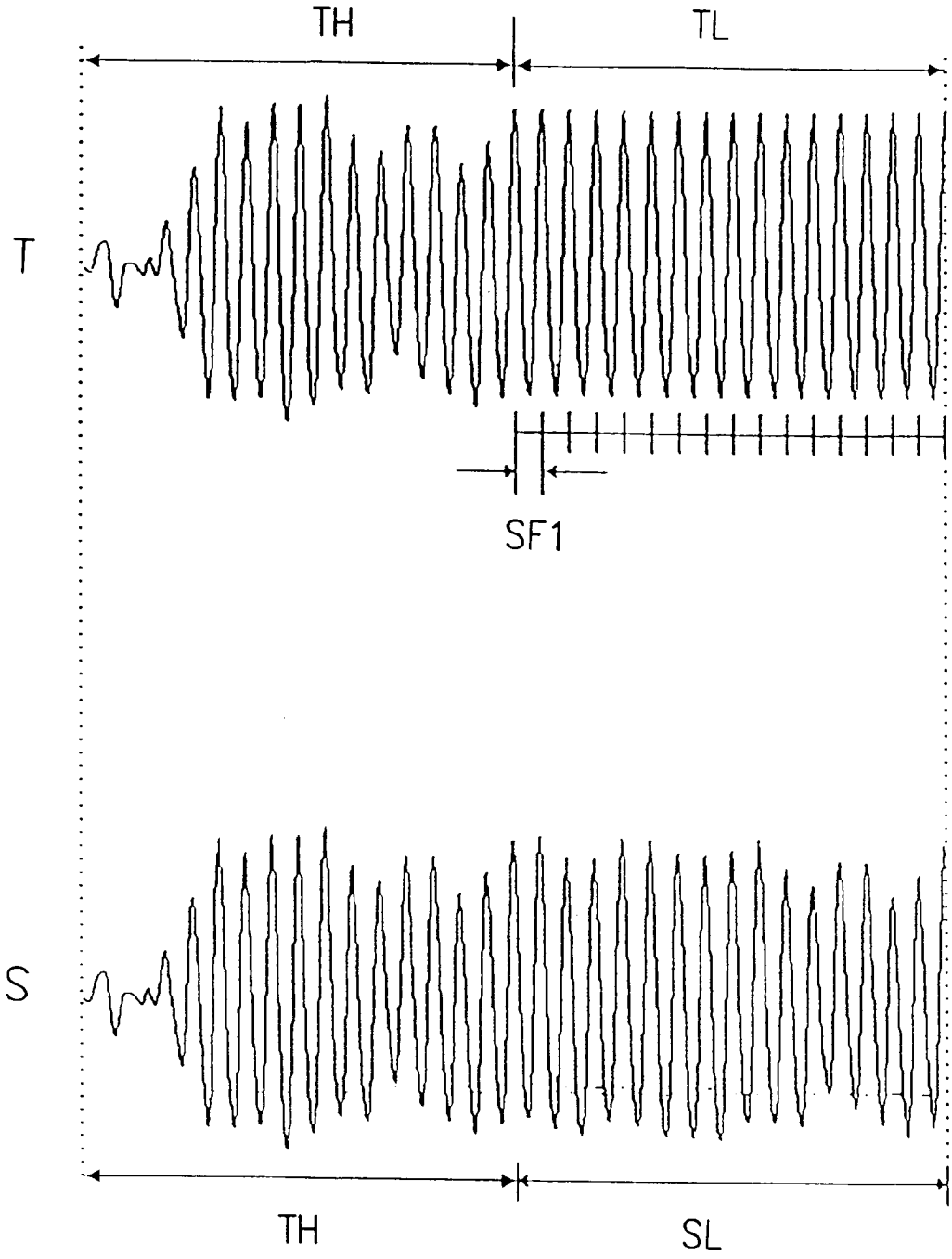
FIG. 15 is a schematic plot of the T sample and the S sample for comparison, according to the preferred embodiment of the invention.

In order to solve the trembling sound phenomenon, a procedure is performed. FIG. 14 is a schematic plot of a T sample that is a result from the S sample with the single period waveform SF1, which is processed by the COS modulation, according to the preferred embodiment of the invention. In FIG. 14, a single period waveform SL1 of the SL is extracted. The single period waveform SL1 is preferably extracted from the first period of the SL. An abutting waveform SP1 with an equal length to the SL1 is obtained, in which the SP1 is the last portion of the TH (FIG. 12) abutting the SL1. The SL1 and the SP1 are processed by the COS modulation described by Eq. 1, in which N is replaced by the total number of sample points of the SL1, and both the EL and the EP are respectively replaced by the SL1 and the SP1 so as to obtain a single period waveform SF1. The single period waveform SF1 is connected to the pre-waveform TH and is repeated so as to obtain a timbre sample T shown in FIG. 15. FIG. 15 is a schematic plot of the T sample and the S sample for comparison, according to the preferred embodiment of the invention. The SF1 is repeated until the T sample and the S sample have equal length. The SF1 is repeated M−1 times, for example, to form a TL in the T sample. The total length of the TL therefore has M times the SF1. The difference between the T sample and the S sample is the TL and the SL, in which the TL is a monotonous tone, and the SL is a varying tone. As mentioned before, the S sample is only used to synthesize a sound, so the trembling sound phenomenon inevitably occurs.

Figure 16:
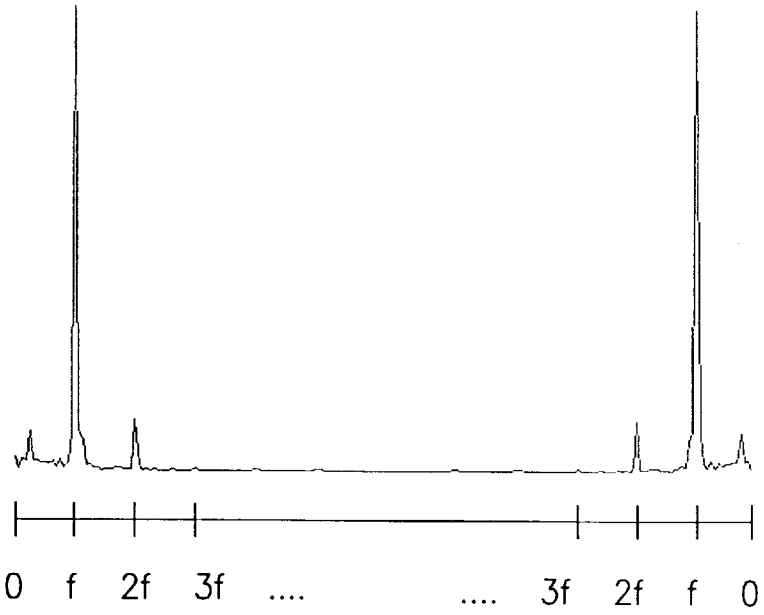
FIG. 16 is a schematic plot of an absolute of the SLF in the frequency domain, according to the preferred embodiment of the invention.

The invention introduces a method to reduce the trembling sound phenomenon by performing a digital Fourier transformation. The SL of the S sample is transformed into a frequency domain by the digital Fourier transformation so as to obtain a Fourier function SLF, which includes several modes with different frequency bases. Taking an absolute of the SLF, an SLF distribution along a frequency axis is shown in FIG. 16. If a single basic period of the S sample has P sample points, the SL has M·P points. Here M is timed because the total length of the TL has M times the SF1. The SLF is expressed in points from SLF[0] through SLF[M·P−1], in which each SLF[M], SLF[2M], . . . , and SLF[M·P−1] represents a frequency base and is designated by "f". The SLF distribution includes several high frequency modes, which are the main factors causing the trembling sound.

Figure 17:
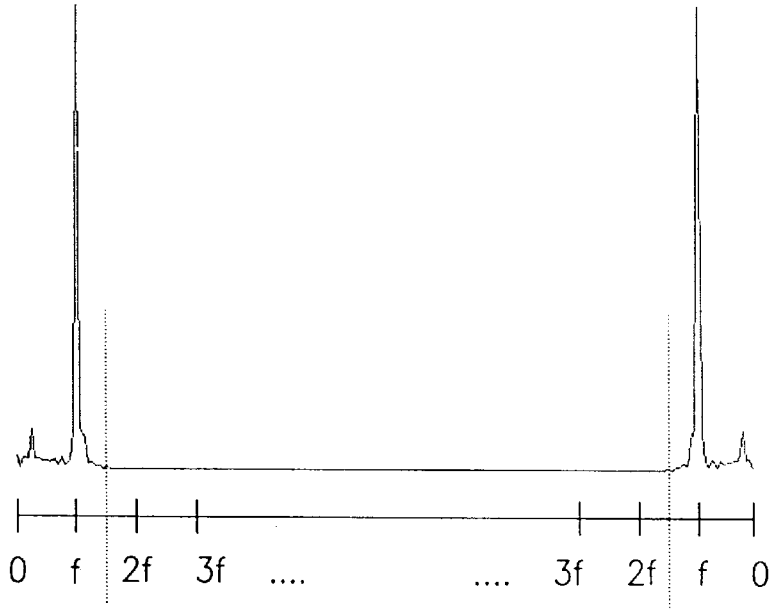
FIG. 17 is a schematic plot of an absolute of the NSLF in the frequency domain after a process of low frequency response, according to the preferred embodiment of the invention.

In FIG. 17, the SLF distribution is processed by an operation of a low frequency response, which means that some high frequency modes are removed by setting them to zero. After an operation of the low frequency response, another NSLF Fourier function in the frequency domain is obtained. For example, if a frequency K is set at 1.5 f, all the SLF distribution greater than 1.5 f are set to zero. A NSLF is obtained. A zero quantity of the SLF means that its frequency response is off. In more detail, the points SLF[0]–SLF[K·M] and the points SLF[M·P−K·M]–SLF[M·P−1] remain and the other SLF points are set to zero.

Figure 18:
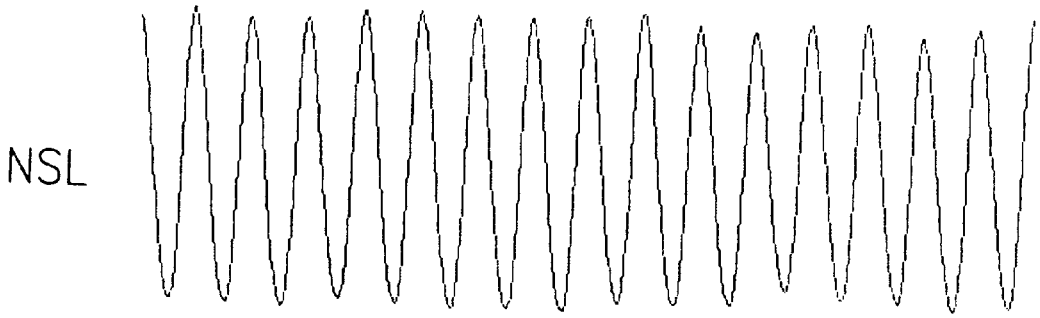
FIG. 18 is a schematic plot of the NSL, according to the preferred embodiment of the invention.
Figure 19:
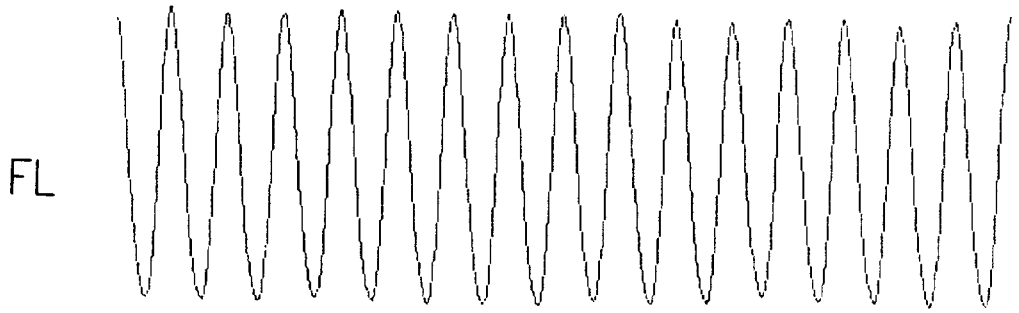
FIG. 19 is a schematic plot of the FL, according to the preferred embodiment of the invention.

After the operation of the low frequency response, the NSLF function is transformed back to the usual space domain so as to obtain a repeated waveform unit length NSL shown in FIG. 18. The NSL originates from the SL.

The TL of the T sample in FIG. 15 and the NSL are added up to obtain an SUML, which is further normalized to the power of the TL. A repeated waveform unit length FL is therefore obtained. The FL is obtained by an arithmetic operation. For example, $$FL = SUML \cdot \frac{\|TL\|}{\|SUML\|},$$

$$\text{where } \|TL\| = \sum_{i=o}^{M \cdot P-1} TL^2(i), \text{ and } \|SMUL\| = \sum_{i=0}^{M \cdot P-1} SUML^2(i).$$

Figure 20:
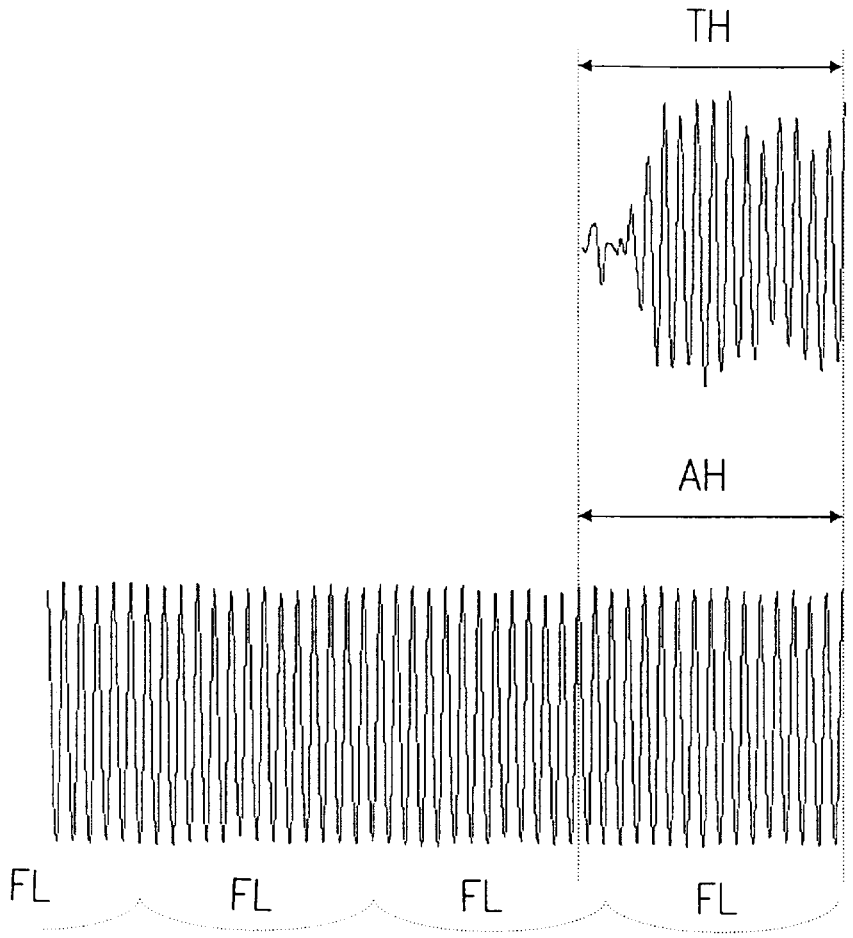
FIG. 20 is a schematic plot of the pre-waveform AH, according to the preferred embodiment of the invention.

In FIG. 20, the FL is repeatedly connected to form a temporary waveform with a length greater than the pre-waveform TH. A last portion AH of the temporary waveform a length equal to the length to the pre-waveform TH is extracted.

Figure 21:
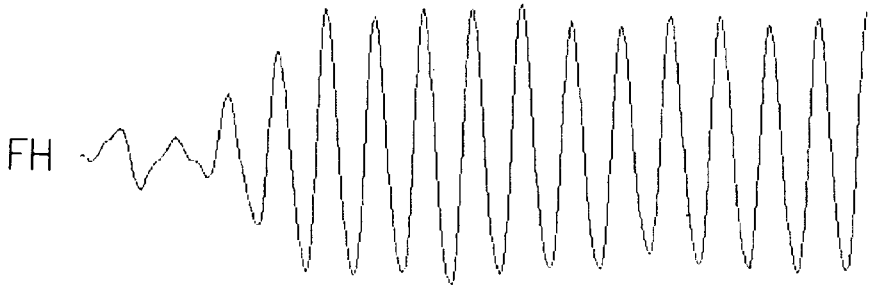
FIG. 21 is a schematic plot of the pre-waveform FH, according to the preferred embodiment of the invention.

An arithmetic operation, called a linear cross fading, is performed on the TH and the AH so as to produce a pre-waveform FH shown in FIG. 21, which therefore includes a natural fading property of the TH. The FH is obtained by the operation with a formula shown in Eq. 2:

$$FH(i) = TH(i) \cdot \frac{(D-i)}{D} + AH(i) \cdot \frac{i}{D}, \; i = 0, 1, \ldots, D-1, \tag{2}$$

where D is the total sample points of the pre-waveform TH.

Figure 22:
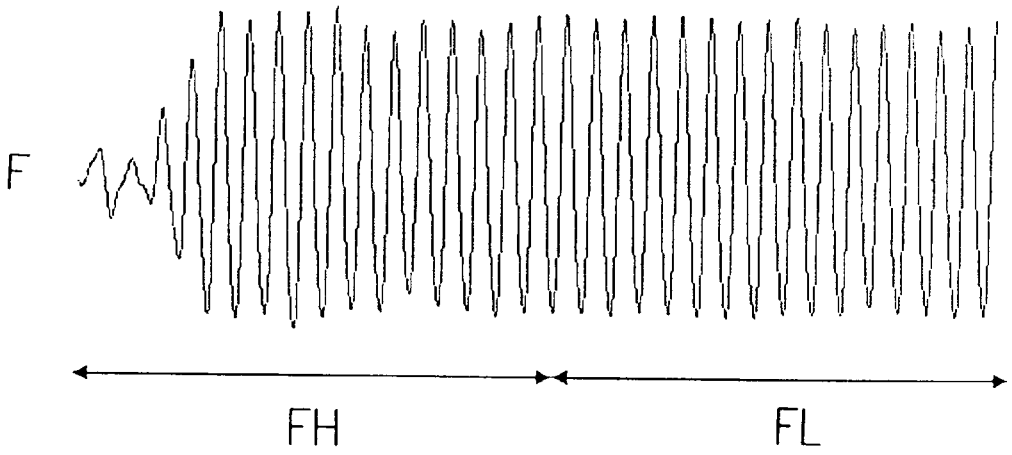
FIG. 22 is a schematic plot of the F sample, according to the preferred embodiment of the invention.

The pre-waveform FH and the FL are connected together to form an improved timbre sample F shown in FIG. 22. The FL is repeatedly connected to synthesize a facsimile sound waveform.

As a result, since the F sample has low frequency rich property, the sound manifests almost has trembling sound phenomenon. A frequency cutoff K in FIG. 17 is preferably set at 1.5 F, which is globally suitable for most timbres. There is no need to change it for each synthesizing process. The whole method can be programmed once at the beginning for all sound samples. This effectively improves the synthesizing quality and reduces the time needed to build up the waveform databank. The structure of the music synthesizer is simplified and is more easily and systematically operated.

In conclusion, the invention achieves a goal that the synthesized sound satisfies the four conditions C1, C2, C3, and C4. In the invention, COS modulation is performed twice to smooth the waveform joint so as to prevent a noise from occurring. A process including performing the digital Fourier transformation, processing low frequency response, and performing the inverse digital Fourier transformation can prevent a sound trembling effect due to high frequency modes from occurring. A linear cross fading operation is performed to obtain a smooth connection between the pre-waveform FH and the FL.

The invention has been described using an exemplary preferred embodiment. However, it is to be understood that the scope of the invention is not limited to the disclosed embodiment. On the contrary, it is intended to cover various modifications and similar arrangements. The scope of the claims, therefore, should be accorded the broadest interpretation so as to encompass all such modifications and similar arrangements.

What is claimed is:

1. A method for synthesizing a synthesized sound waveform, the method at least comprising:

providing a first timbre sample S having a first repeated waveform SL at its last portion, and a second repeated timbre sample TL that has equal length to the first repeated waveform SL;

replacing the first repeated waveform SL of the first timbre sample S with the second repeated waveform TL so as to form a second timbre sample T, in which a portion of the first timbre sample S other than the first repeated waveform SL forms a first pre-waveform TH;

transforming the first repeated waveform SL into a frequency domain by a digital Fourier transformation, extracting low frequency modes, and transforming the low frequency modes of the first repeated waveform SL back into an original space domain so as to form a third repeated waveform NSL;

adding the second repeated waveform TL to the third repeated waveform NSL so as to obtain a fourth repeated waveform SUML;

normalizing a power of the fourth repeated waveform SUML to a power of the second repeated waveform TL so as to obtain a fifth repeated waveform FL; and connecting the fifth repeated waveform FL to the first pre-waveform TH so as to obtain a synthesized timbre sample F, which can be used to synthesize the synthesized sound waveform by repeating the synthesized timbre sample F.

2. The method of claim 1, wherein before the step of connecting the fifth repeated waveform FL to the first pre-waveform TH, the method further comprises:

repeatedly connecting the fifth repeated waveform FL until a length greater than the length of the first pre-waveform TH is obtained, and extracting a last portion of the repeated fifth repeated waveform FL with a length equal to a length of the first pre-waveform TH so as to obtain a second pre-waveform AH; and operating a linear cross fading operation on the first pre-waveform TH and the second pre-waveform AH so as to obtain a third pre-waveform FH with a natural fading property, in which the third pre-waveform FH replaces the first pre-waveform AH before being connected.

3. The method of claim 2, wherein the step of operating the linear cross fading operation comprises an operation following an equation:

$$FH(i) = TH(i) \cdot \frac{(D-i)}{D} + AH(i) \cdot \frac{i}{D}, i = 0, 1, \ldots, D-1,$$

where D is total sample points of the first pre-waveform TH.

4. The method of claim 1, wherein in the step of transforming the first repeated waveform SL into the frequency domain, the low frequency modes comprise a frequency range K that is less than 1.5 of a frequency base f.

5. The method of claim 1, wherein the step of normalizing the power of the fourth repeated waveform SUML to the power of the second repeated waveform TL comprises timing each sample point of the fourth repeated waveform SUML by a factor, which is a ratio of a summation of each sample point square of the second repeated waveform TL to a summation of each sample point square of the fourth repeated waveform SUML.

6. The method of claim 1, wherein the method further comprises:

providing a plurality of digital native sound waveform files;

selecting one of the digital native sound waveform files, and extracting a sufficient fixed length of waveform from a beginning point so as to form a basic timbre sample E;

selecting a last portion of waveform of the basic timbre sample E with a repeated length to form a basic repeated waveform EL, in which the repeated length is a unit length and is to be repeated while synthesizing the synthesized sound waveform, wherein a portion of the basic timbre sample E other than the basic repeated waveform EL forms the first pre-waveform TH;

operating a first junction modulation on the basic repeated waveform EL with a first previous waveform EP, which is selected from a last portion of the first pre-waveform TH with a length equal to the repeated length, so as to form the first repeated waveform SL;

replacing the basic repeated waveform EL of the basic timbre sample E with the first repeated waveform SL so as to form the first timbre sample S;

operating a second junction modulation on a first basic single period SL1 of the second repeated waveform SL with a second previous waveform SP1 from the last portion of the first pre-waveform TH with a length equal to a length of the first basic single period SL1 so as to form a single period waveform SF1; and repeatedly connecting the single period waveform SF1 to form the second repeated waveform TL, which has a length equal to the length of the first repeated waveform SL.

7. The method of claim 6, wherein a sufficient fixed length of the basic timbre sample E is generally applied to all the digital native sound waveform files.

8. The method of claim 6, wherein the sufficient fixed length is a least common multiple (LCM) of all the digital native sound waveform files.

9. The method of claim 6, wherein the basic repeated waveform EL of the basic timbre sample E comprises a single basic period of the basic timbre sample E.

10. The method of claim 6, wherein the digital native sound waveform files are obtained by recording original sound waveforms from actual music instruments and digitizing the original sound waveforms.

11. The method of claim 6, wherein the basic repeated waveform EL of the basic timbre sample E comprises a plurality of basic periods of the basic timbre sample E.

12. The method of claim 6, wherein the repeated length of the basic repeated waveform EL comprises an integer repeated time of a single basic period of the basic timbre sample E and is not greater than the length of the basic timbre sample E.

13. The method of claim 6, wherein the first junction modulation comprises an arithmetic operation following an equation:

$$SL(k) = EL(k) \cdot \frac{1+\cos\left(\frac{k\pi}{N}\right)}{2} + EP(k) \cdot \frac{1-\cos\left(\frac{k\pi}{N}\right)}{2},$$

$$k = 1, 2, \ldots N,$$

in which there are N sample points in the first repeated waveform SL, and each point is denoted by k.

14. The method of claim 6, wherein the second junction modulation comprises an arithmetic operation following an equation:

$$SF1(k) = SL1(k) \cdot \frac{1+\cos\left(\frac{k\pi}{M}\right)}{2} + SP1(k) \cdot \frac{1-\cos\left(\frac{k\pi}{M}\right)}{2},$$

-continued $$k = 1, 2, \ldots M,$$

in which there are M sample points in the single period waveform SF1, and each point is denoted by k.

15. The method of claim 6, wherein the first junction modulation and the second junction modulation comprises an arithmetic operation so as to adjust the first repeated waveform EL and the first basic single period SL1 to have a smooth junction curve.

* * * * *